United States Patent [19]

Chu et al.

[11] Patent Number: 4,630,950

[45] Date of Patent: Dec. 23, 1986

[54] PAPER BAIL FOR A PRINTER AND ASSOCIATED METHODS OF OPERATION THEREOF

[75] Inventors: Mosi Chu, Setauket; Meng S. Kuo, Ronkonkoma, both of N.Y.

[73] Assignee: Primages, Inc., Ronkonkoma, N.Y.

[21] Appl. No.: 645,445

[22] Filed: Aug. 29, 1984

[51] Int. Cl.[4] ..... B41J 13/16; B41J 13/20

[52] U.S. Cl. ..... 400/639.1; 400/645; 400/645.5; 400/641

[58] Field of Search ..... 400/608.1, 639–639.2, 400/645, 645.4, 645.5, 641

[56] References Cited

U.S. PATENT DOCUMENTS

| | | | |
|---|---|---|---|
| 1,016,250 | 2/1912 | Coo | 400/608.1 |
| 1,131,997 | 3/1915 | Cooper | 400/645.5 |
| 1,469,482 | 10/1923 | Orr | 400/608.1 |
| 1,698,426 | 1/1929 | Blaisdell | 400/608.1 |
| 1,967,941 | 7/1934 | Kellogg | 400/645.4 |
| 2,080,524 | 5/1937 | Allen | 400/639 |
| 2,772,765 | 12/1956 | Maroth | 400/639.1 |
| 3,095,078 | 6/1963 | Zeamer | 400/639.2 |
| 3,468,249 | 9/1969 | Tseo | 101/235 |
| 4,076,112 | 2/1978 | Effinger | 400/639.2 |

FOREIGN PATENT DOCUMENTS

| | | | |
|---|---|---|---|
| 552610 | 6/1932 | Fed. Rep. of Germany | 400/639.1 |
| 659453 | 5/1938 | Fed. Rep. of Germany | 400/641 |
| 3142700 | 5/1983 | Fed. Rep. of Germany | 400/639.1 |

OTHER PUBLICATIONS

Kroeker, "Paper Bail" *IBM Technical Disclosure Bulletin,* vol. 25, No. 8, p. 4214, 1/83.

Rachni, "Printer Paper Bail Rollers" *IBM Technical Disclosure Bulletin,* vol. 18, No. 11, p. 3537, 4/76.

Blythe "Double Rollers . . . " *IBM Technical Disclosure Bulletin,* vol. 16, No. 2, p. 522, 7/73.

*Primary Examiner*—William Pieprz

*Attorney, Agent, or Firm*—Roberts, Spiecens & Cohen

[57] ABSTRACT

Paper bail apparatus for a printer comprising a frame mounted on a non-circular paper bail shaft of a printer and rotatably supporting a pair of rollers for contact with the platen of the printer along two separate lines of contact which are circumferentially spaced on the platen and longitudinally offset from one another. The frame is made from plastic material and the rollers are snap-fit in the frame. The frame has a projection at an inlet guide for guidable entry of the paper between the rollers and the platen.

20 Claims, 4 Drawing Figures

PAPER BAIL FOR A PRINTER AND ASSOCIATED METHODS OF OPERATION THEREOF

FIELD OF THE INVENTION

The invention relates to an improved paper bail apparatus particularly for use with a printer.

The invention also relates to associated methods of operation of the printer with the improved paper bail apparatus, particularly the guidable feed of paper after the paper has been printed.

BACKGROUND OF THE INVENTION

Conventional paper bails for printers consist of a paper bail shaft on which are rotatably supported a plurality of individual paper bails. These bails are in the form of rollers which are slidable along the axis of the paper bail shaft and are applied with pressure against the platen so as to guidably advance the paper after it has been printed.

The pressure of the paper bail rollers against the platen is produced with springs that are in engagement with a holder that can move the paper bail shaft between operative and inoperative positions.

A number of problems are evident in conventional paper bails and these become accentuated in high speed printers, particularly at the end of a page of printing.

More particularly, the bail shaft is relatively long and not especially rigid so that pressure variation of the bails against the platen can be substantial which can lead to incomplete pressing of the paper against the platen and consequent misfeed of the paper.

Additionally, at the bottom of a page, when the paper has been released from the friction rollers which hold the paper against the platen, the paper is now free to be dislodged and is only held against the platen by the paper bail rollers. As a consequence, the last few lines of printing on the paper may become irregular and frequently it is noted that the last lines of printing are skewed at an angle.

Additionally, a further requirement currently made upon printers is to have so-called "multi-strike" capability. This requires that different characters be imprinted at the same place offset vertically a plurality of times. This requires careful registration of the print element and the printed character in order to prevent offset overlap of the printed character. As previously explained, at the end of the paper when the paper is only held by the rollers of the paper bail against the platen, the paper can shift leading to offset of the printed multistruck character.

A deficiency of the known construction in which the paper bail rollers are capable only of sliding movement on the paper bail shaft is that it is necessary for an operator to raise the paper bail shaft every time it is necessary to insert a sheet of paper under the paper bail.

SUMMARY OF THE INVENTION

An object of the invention is to provide paper bail apparatus which will satisfy the needs of high-speed printers and avoid the disadvantages noted above of the conventional paper bail constructions.

A further object of the invention is to provide paper bail apparatus in which the paper will be guidably supported by the apparatus even at the last few lines of printing when the paper has become disengated from the friction rollers.

Yet another object of the invention is to provide paper bail apparatus which is simple in construction and relatively inexpensive and which also has the capability of being adjusted along the paper bail shaft.

Still another object of the invention is to provide a method by which paper is guidably held on the platen by the paper bail apparatus in a manner to provide multi-strike capability at the last few lines of a printed sheet.

Another object of the invention is to provide paper bail apparatus which permits insertion of sheets of paper between the platen and the paper bail rollers without raising the paper bail shaft.

In accordance with the above and further objects of the invention, there is provided paper bail apparatus for a printer which comprises a frame having an opening for a paper bail shaft adjacent a platen of the printer and roller means supported by the frame for rollingly contacting the platen along two separate lines of contact.

In further accordance with the invention, the frame is non-rotatable on the paper bail shaft and the lines of contact are circumferentially spaced along the platen.

The invention further contemplates that the roller means comprises two rollers, each supported for rotation in the frame, and advantageously snap-fitted into the frame for ease of assembly.

According to a further feature of the invention, the rollers are supported in the frame not only to provide for circumferentially spaced lines of contact on the platen, but additionally for lines of contact which are laterally offset from one another in the axial direction of the paper bail shaft.

According to still another feature of the invention, the rollers are supported in the frame so as to be resiliently biassed against the platen under the action of spring means interposed between the paper bail shaft and the frame.

The invention also provides a method for guidably feeding the paper on the platen after the paper has been printed at a printing station and in accordance with the method the paper is pressed against the platen downstream of the printing station by a pair of rollers which are adjacent one another and spaced circumferentially along the platen in the direction of feed of the paper.

In further accordance with the method of the invention, the rollers are in frictional contact with the platen and undergo rotation about axes which are longitudinally and transversely offset.

The invention will be described in relation to a specific embodiment thereof in accordance with the illustration in the attached figures of the drawing.

DETAILED DESCRIPTION OF A PREFERRED EMBODIMENT

Figure 1:
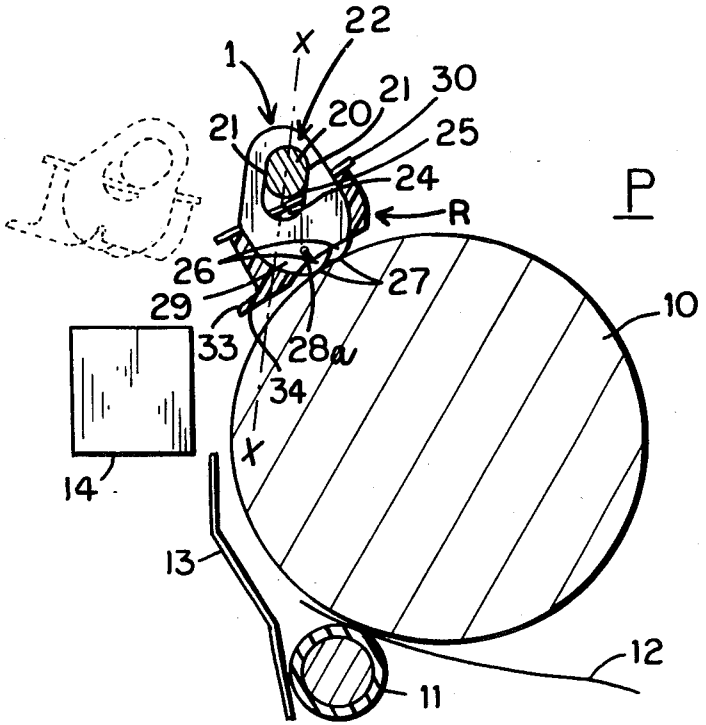
FIG. 1 is a side elevational view of a portion of a printer with the paper bail apparatus of the invention shown partially in cross-section.

Referring to FIG. 1 of the drawing, there is seen a portion of a printer P which is adapted for use with the paper bail apparatus 1 of the invention.

The printer P comprises a platen 10 against which a friction roller 11 can be engaged in order to advance a sheet of paper 12 from a supply thereof(not shown) through a guide 13 to a print station S at which a printing operation takes place. At the printing station is disposed a print mechanism 14 which is adapted to effect printing on the paper which is at the printing station S.

The paper bail apparatus 1 is disposed downstream of the print station S and serves to guidably advance the paper to a further downstream station which can be a storage bin or a conveyor which can transport the printed paper to a further station.

The paper bail apparatus 1 comprises a paper bail shaft 20 which is movable between an inoperative position, shown in dotted outline in FIG. 1, and an operative position, shown in solid lines in FIG. 1. As is entirely conventional, the paper bail shaft is connected to a holder which permits the paper bail apparatus to be moved between the operative and inoperative positions. In the operative position, the paper bail apparatus serves to guidably advance the printed paper while in the inoperative position the paper can be fed under the paper bail apparatus and pressed against the platen when the paper bail apparatus is brought to the operative position.

In conventional construction, the paper bail shaft is cylindrical and paper bail rollers are slidably mounted on the shaft for adjustment along the axial length thereof. The paper bail rollers are rotatable on the shaft and their axes of rotation coincide therewith.

In accordance with the invention, the paper bail shaft 20 is non-circular and has a cross-section which is composed of a circle with flatted sides 21. A plurality of paper bail roller assemblies R (only one is shown in the drawing) are mounted on the shaft 20 for slidable adjustment along the axis of the shaft. Each roller assembly R comprises a frame 22 mounted on the shaft 20 so as to be non-rotatable thereon but capable of movement axially along the shaft 20. Additionally, the frame 22 is movable in a direction parallel to the sides 21 along an axis X-X. The frame 22 comprises two parallel end arms 23 each having a respective bore 24 in which shaft 20 is received. The bore 24 has flatted sides 25 which engage the flatted sides 21 of the shaft 20 for slidable movement in the direction of axis X-X. The bores 24 are elongated in the direction of the X-X axis to accommodate the slidable movement of the frame 22.

Figure 2:
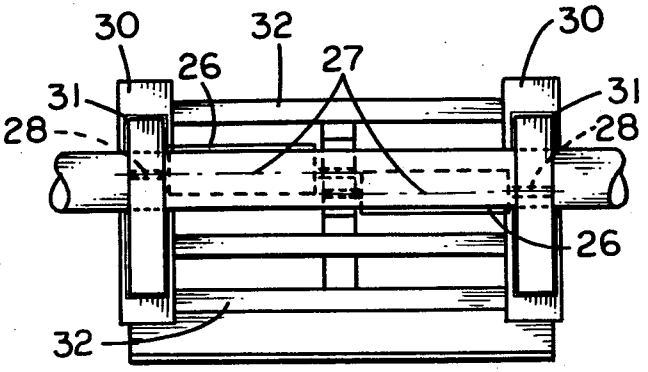
FIG. 2 is a top plan view of the paper bail apparatus illustrated in FIG. 1.
Figure 3:
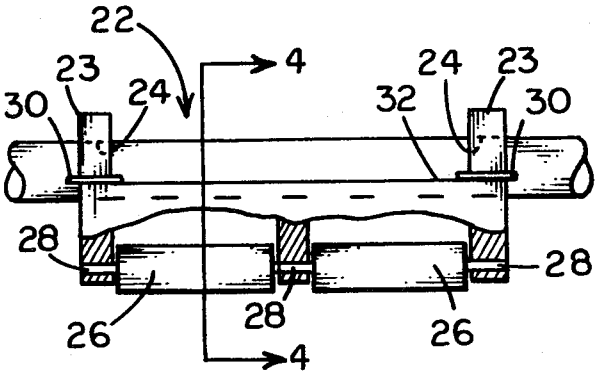
FIG. 3 is a front elevational view partly broken away in section of the paper bail apparatus.

The frame carries a pair of cylindrical rollers 26 which are supported in the frame so as to be in rolling contact with the platen along two separate lines of contact diagrammatically shown at 27 in FIGS. 1 and 2. The lines of contact 27 of the rollers 26 are circumferentially spaced along the platen, as seen in FIG. 1, and they are also laterally offset, as seen in FIG. 2.

Figure 4:
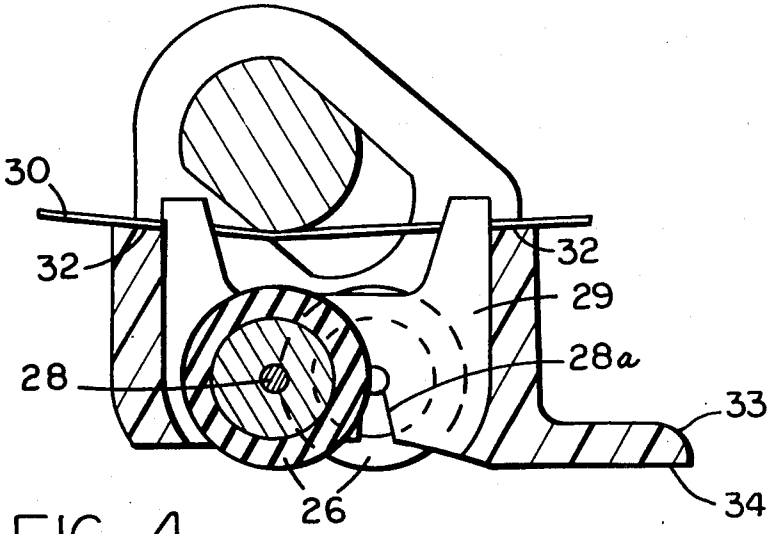
FIG. 4 is a section taken along line 4—4 in FIG. 3.

In order to mount the rollers 26 in the frame for rotation, the rollers are provided with stub-shafts 28 which are respectively engaged in corresponding hole **28*a* in the arms of the frame and in an integral central retainer plate 29 provided with a pair of holes 28*a* receiving stub-shafts of the respective rollers. According to a specific feature of the invention, the holes 28*a* are configured as shown in FIGS. 1 and 4 so as to be tapered in narrowing fashion along a portion of its length and then to open into a part-circular bore to form a keyhole-like shape so that the stub-shafts 28 of the rollers 26 can be snap-fit into the arms of the frame and the retainer plate 29**.

In order to provide resilient action between the paper bail shaft 20 and the frame 22, a pair of springs 30 are applied between the shaft and the frame. More particularly, each spring 30 is of rectangular outline, as seen in FIG. 2, and is provided with a center slot 31 of rectangular shape so as to permit insertion therein of an end arm 23 of the frame. The spring is lowered on the arm so as to rest on longitudinal shoulders 32 at the opposite sides of the frame. The spring is positioned beneath the paper bail shaft 20, as evident from the drawings and, particularly, from FIG. 1 to apply resilient force between the paper bail shaft and the frame and this will be transmitted to the rollers which bear against the platen. As a consequence of the resiliency of the springs, the frame is capable of rectilinear reciprocal movement along axis X-X to accommodate movement of the rollers and to maintain the rollers in pressure contact with the platen 10. The resilient mounting of the rollers 26 by the springs 30 enables an operator to insert a sheet of paper between the platen 10 and the rollers 26 without raising the paper bail shaft 20 to its inoperative position.

The frame 22 has a projection 33 with a lower guide surface 34 at an inlet portion for guiding paper to a position between the rollers 26 and the platen 10.

In operation, the paper bail apparatus 1 is in operative position as shown in FIG. 1 with the paper pressed against the platen 10 by contact with the rollers 26 at the lines of contact 27. The paper can be placed in the operative position either by lifting the paper bail shaft to its inoperative position and putting the paper in place and lowering the paper bail shift to its operative position or by inserting the paper between the lowered rollers 26 and the platen in the operative position, the elastic support of rollers 26 by springs 30 allowing the assembly R and the rollers 26 to be displaced with respect to shaft 20 during insertion of the paper. The position of the paper bail shaft 20 in the operative position is such as to produce deformation of spring 30 which will have the effect of resiliently biassing the rollers 26 against the platen 10.

As a printing operation proceeds, the paper is fed by the friction roller 11 and the platen 10 through the printing station to the paper bail apparatus wherefrom the paper is discharged. When the paper 12 reaches its end and is released from between the friction roller 11 and the platen 10, the paper will still be maintained against the platen 10 resiliently by the rollers 26 at the pairs of lines of contact of the rollers mounted in each frame. As a consequence, the paper will be guidably fed by the rollers 26 which will enable the printed paper to be capable of being printed by multi-strike techniques. Also, because of the resilient and guidable engagement of the paper by the rollers at offset locations both transversely and longitudinally, the paper will be reliably held so that the printing will be straight right down to the last line of printing on the paper.

The frame 22 can be molded from an integral piece of thermoplastic material and the rollers 26 are easilly assembled by snap-engagement in the holes **28*a***. As a consequence, the cost of the frame and rollers and its assembly can be greatly minimized.

Although the invention has been described in relation to a specific embodiment, there will become obvious to those skilled in the art that numerous modifications and variations can be made within the scope and spirit of the invention as defined in the attached claims.

I claim:

1. Paper bail apparatus for operation with a platen of a printer comprising a paper bail shaft movable between an operative position adjacent the platen of the printer and an inoperative position remote from the platen, and a plurality of paper bail assemblies mounted on said paper bail shaft, each paper bail assembly comprising a frame non-rotatably supported on said shaft and movable for slidable displacement radially of the shaft in a plane substantially perpendicular to the axis of the shaft, spring means mounted on said frame for engaging said shaft to urge the frame in its direction of slidable displacement radially of the shaft to a lowered position on said shaft, and two rollers mounted on said frame for rotation about respective axes which are at offset locations for rollingly contacting the platen along two separate lines of contact under the urging of said spring means with the paper bail shaft in its operative position, said rollers being supported in the frame with their axes of rotation transversely offset from one another such that the rollers are circumferentially spaced on said platen.

2. Apparatus as claimed in claim 1 wherein said shaft has a non-circular cross-section and said opening in said frame is non-circular.

3. Apparatus as claimed in claim 2 wherein said opening is elongated and has opposite flat sides which are slidable on the shaft.

4. Apparatus as claimed in claim 3 wherein the shaft is a cylinder with a pair of opposite flatted sides, said flat sides of said opening slidably engaging the flatted sides of the shaft.

5. Apparatus as claimed in claim 4 wherein the maximum length of the opening as measured parallel to the sides is greater than the diameter of the shaft to permit the slidable movement of the frame radially on the shaft.

6. Apparatus as claimed in claim 1 wherein said frame includes an inlet portion for guiding paper to a position between the rollers and the platen.

7. Apparatus as claimed in claim 6 wherein said inlet portion includes a projection having a lower guide surface.

8. Apparatus as claimed in claim 1 wherein said rollers are snap-fit in said frame.

9. Apparatus as claimed in claim 1 wherein said spring means comprises a flat spring member resting on said frame and bearing against said shaft.

10. Apparatus as claimed in claim 9 wherein said spring member has a slot through which said frame projects.

11. Apparatus as claimed in claim 10 wherein said frame includes an arm engaged in said slot and shoulders on which said spring member rests.

12. Apparatus as claimed in claim 1 wherein the axes of rotation of said rollers are offset from the axis of the paper bail shaft.

13. Apparatus as claimed in claim 1 wherein said spring means applies a force to said frame to urge the frame to its lowered position, which force is directed along an axis which is offset from and inclined relative to the axes of said rollers.

14. In a printer having a platen and plurality of paper bails mounted on a paper bail shaft adjacent the platen for guidably advancing the paper after a printing operation, the improvement wherein each paper bail comprises a frame non-rotatably supported on the shaft and movable for slidable displacement radially of the shaft in a plane substantially perpendicular to the axis of the shaft, spring means mounted on said frame for engaging said shaft to urge the frame in its direction of slidable displacement radially of the shaft to a lowered position on said shaft, and two rollers mounted on said frame for rotation about respective axes which are at offset locations for rollingly contacting the platen along two separate lines of contact under the urging of said spring means with the paper bail shaft in its operative position, said rollers being supported in the frame with their axes of rotation transversely offset from one another such that the rollers are circumferentially spaced on said platen.

15. The improvement as claimed in claim 14 wherein the shaft has the cross-section of a cylinder with opposite flatted sides, and said opening in the frame is elongated and has opposite flat sides which are slidable on the flatted sides of the shaft, said frame being slidable axially of said shaft by slidable movement of said flatted sides of the frame on the flat sides of the shaft.

16. The improvement as claimed in claim 15 wherein said spring means comprises a flat spring member resting on said frame and bearing against said shaft along a cylindrical surface thereof.

17. The improvement as claimed in claim 16 wherein said spring member has a slot, said frame including a projecting arm engaged in said slot and shoulders on which said spring member rests.

18. The improvement as claimed in claim 14 wherein said rollers are supported on said frame in spaced relation axially of said shaft.

19. The improvement as claimed in claim 14 wherein the axes of rotation of said rollers are offset from the axis of the paper bail shaft.

20. The improvement as claimed in claim 14 wherein said spring means applies a force to said frame to urge the frame to its lowered position, which force is directed along an axis which is offset from and inclined relative to the axes of said rollers.

* * * * *